US005522177A

United States Patent [19]

Davis

[11] Patent Number: 5,522,177

[45] Date of Patent: Jun. 4, 1996

[54] CHRISTMAS TREE STAND

[76] Inventor: John H. Davis, 3796 Stewart Rd., Eugene, Oreg. 97402

[21] Appl. No.: 387,210

[22] Filed: Feb. 13, 1995

[51] Int. Cl.[6] ..... A47G 7/02; A47G 33/12

[52] U.S. Cl. ..... 47/40.5; 248/524

[58] Field of Search ..... 47/40.5; 248/519, 248/533, 524, 527

[56] References Cited

U.S. PATENT DOCUMENTS

| | | | |
|---|---|---|---|
| 1,159,353 | 11/1915 | Bergwall | 248/519 |
| 1,481,015 | 1/1924 | Klein . | |
| 1,912,054 | 5/1933 | Wright | 47/40.5 |
| 1,943,269 | 1/1934 | Holden | 47/40.5 |
| 2,500,215 | 3/1950 | Swearingen . | |
| 2,733,032 | 1/1956 | Farley et al. | 47/40.5 |
| 3,028,132 | 4/1962 | Austenson | 47/40.5 |
| 3,045,959 | 7/1962 | Herrington | 47/40.5 |
| 3,136,514 | 6/1964 | Rzepela . | |
| 3,142,464 | 7/1964 | Zelenitz | 47/40.5 |
| 3,562,951 | 2/1971 | Schwaderlapp . | |
| 3,693,918 | 9/1972 | Fisher et al. | 248/524 |
| 3,697,026 | 10/1972 | Hambrick . | |
| 4,254,578 | 3/1981 | Hanfeld . | |
| 4,477,049 | 10/1984 | Davis . | |

FOREIGN PATENT DOCUMENTS

| | | |
|---|---|---|
| 658283 | 2/1963 | Canada . |
| 1484784 | 9/1977 | United Kingdom . |

*Primary Examiner*—Terry Lee Melius
*Assistant Examiner*—Joanne C. Downs
*Attorney, Agent, or Firm*—Eugene M. Eckelman

[57] ABSTRACT

An upwardly extending post is welded at its lower end to a base ring and is inclined for holding a depending bar at an inner portion of the ring. The depending bar has a bottom horizontal foot plate that extends integrally therefrom. This foot plate carries a reinforcing wedge plate and a set pin. In attaching a tree to the holder, the wedge plate engages the tree trunk radially and the set pin engages the tree trunk at the bottom in laterally spaced relation from the wedge plate, thus providing a two point engagement that prevents twisting of the tree in the holder. A single cinching crank screw is mounted in an upper portion of the depending bar for penetrating the tree and pulling the tree tightly against the depending bar.

2 Claims, 1 Drawing Sheet

CHRISTMAS TREE STAND

BACKGROUND OF THE INVENTION

This invention relates to new and useful improvements in Christmas tree stands.

Various types of Christmas tree stands have heretofore been provided. Such stands basically provide structure that engages the tree trunk at the bottom for supporting the tree and that also engages the tree upwardly from the bottom for steadying it vertically. Broad examples of such structures are shown in U.S. Pat. Nos. 1,481,015, 2,500,215, 3,697,026, 4,254,578, and 1,484,784 United Kingdom. Some of these patents also can be combined with pans for immersing the bottom of the trunk in water pans in order to provide moisture for a tree in the holder. Applicant herein has heretofore conceived a Christmas tree stand with the above basic structure and with substantial improvements in the art as well. Such improvements are shown in his U.S. Pat. No. 4,477,049.

The purpose of the present invention is to further improve on Christmas tree stands in simplification, sturdy support of a tree, and to prevent twisting of the tree. In accomplishing these improvements, the present stand comprises a base ring and an upwardly extending post having a lower end secured integrally to the base ring. The post is inclined toward an inner portion of the base ring and supports a vertical tree holding bar that in turn supports a bottom horizontal foot plate from which first and second tree trunk piercing means project. This pair of trunk piercing means positively provide a connection to the trunk of the tree to hold the tree upright and also prevent the tree from twisting. The first tree trunk piercing means comprises a wedge member that penetrates the tree radially through the bark and the second piercing means comprises an axially movable set pin that can be withdrawn in an initial step of mounting the tree on the holder but then can be pounded in place axially to accomplish one of the final steps in setting a tree on the holder. This device uses a crank screw at its upper end for cinching the tree tightly onto the holder.

The invention will be better understood and additional objects and advantages will become apparent from the following description taken in connection with the accompanying drawings.

DETAILED DESCRIPTION OF A PREFERRED EMBODIMENT

Figure 1:
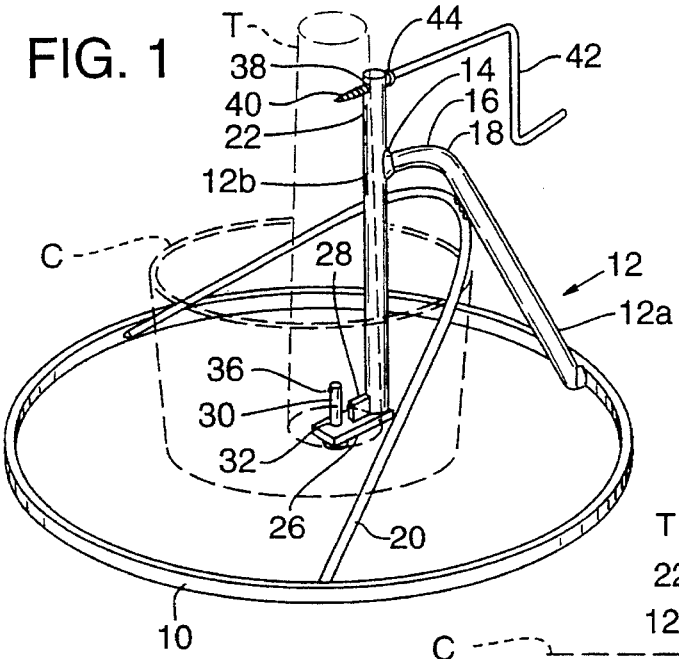
FIG. 1 is a perspective view of the present tree stand with the trunk of the tree and a water container shown in broken lines.

The invention comprises a metal base 10 preferably circular in shape and also preferably of metal. A tree engaging and holding member 12 includes an inclined support post 12*a* welded at its bottom end to the base 10. The upper end 14 of the support post 12*a* terminates short of the axis point of the base 10. A portion 16 of the post 12*a* at the top is horizontal. This horizontal portion is formed by an inward bend 18 in the inclined post. An inverted U-shaped brace 20 is welded in inclined position between the base ring and the post 12*a*.

Suspended integrally from the upper end of post 12*a* with the bottom thereof disposed in a plane above the bottom edge of base 10 is an upright tree holding bar 12*b*. This bar is welded integrally to the post at a point below the top of the bar, thus leaving a projecting portion 22 of the bar above its connection to the post.

The bottom of the depending bar portion 12*b* has an integral right angle foot plate 26 that supports a tree T. The foot plate may assume varying lengths depending on the size of the stand but for the average tree stand it is approximately 4 inches long, 1 inch wide, and ½ inch thick. The outer end of this foot plate is offset from the center of the base 10 to allow the tree to be approximately centered in the base, especially trees with large diameter trunks. A gusset or wedge plate 28 is welded on edge in the inside corner between the bottom end of bar portion 12*b* and the foot plate 26. This wedge plate reinforces the projecting support of the foot plate on the bar portion 12*b* and also will penetrate the tree in a mounted position of a tree on the stand, as will become more apparent hereinafter. This wedge plate measures on the average approximately 1 inch in height and ¾ inch along the foot plate in an average size base 10.

A set pin 30 is mounted in the foot plate 26 adjacent the outer or free end of the foot plate and is freely movable axially in an aperture 32 in the foot plate. Pin 30 has a head 34 on the bottom and a lateral stop projection 36, such as a drop of weld metal, on the other end. This pin thus has axial movement relative to the foot plate but is trapped in its axial movement by its head and projection 36 to prevent displacement.

The upper end of the depending bar portion 12*b* has a cross bore 38 that extends axially in the same direction as the foot plate 26. This bore freely receives a tree penetrating cinching screw portion 40 of a screw crank 42. The screw crank includes an abutment 44 at the rearward end of the screw portion 40 that abuts against the tree holding bar 12*b* and serves to cinch up the bar against the tree, as will be apparent hereinafter.

Figure 2:
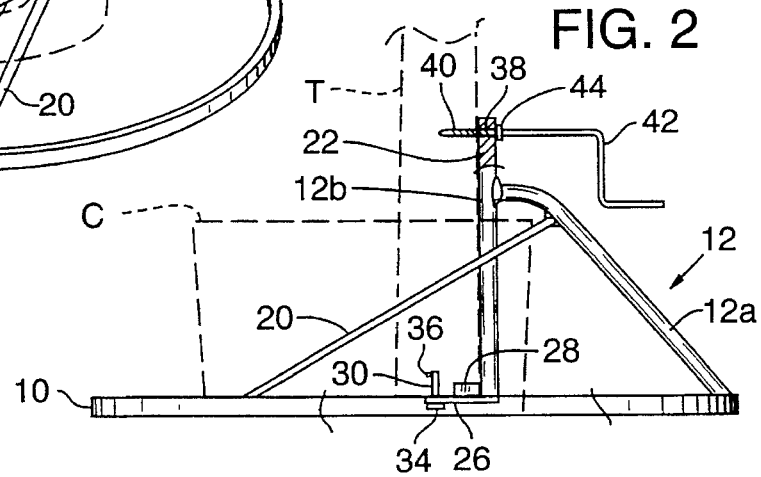
FIG. 2 is a side elevational view.
Figure 3:
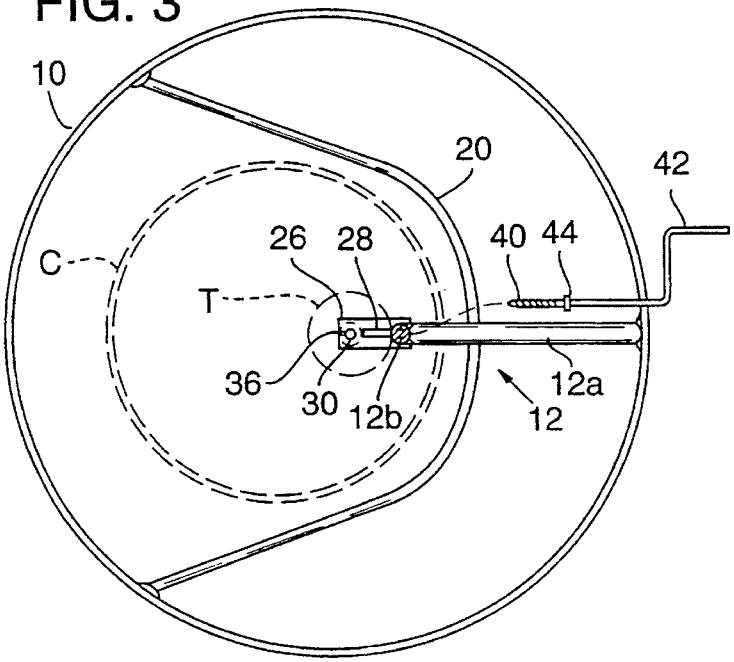
FIG. 3 is a to plan view.
Figure 4:
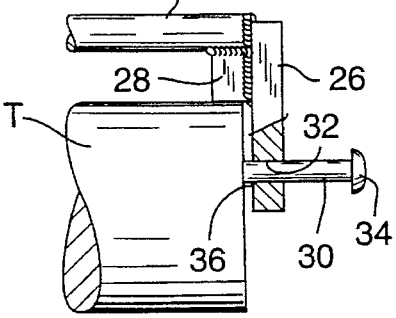
FIGS. 4 and 5 are enlarged fragmentary side elevational views of the stand showing steps of mounting the stand on a tree.
Figure 5:
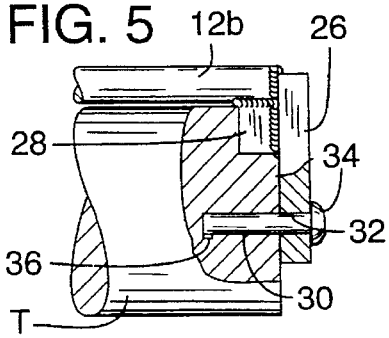

For mounting a tree on the holder, reference is first made to FIG. 4. The bottom of the tree is first squared off and then the tree is laid horizontal. The holder in the tipped up edge position of FIG. 4 is brought down in a radial direction relative to the tree. At this time, the set pin 30 is retracted rearwardly as shown. In bringing the stand down radially, the foot plate 26 is moved along closely to the butt end of the tree. Movement of the stand down will be interrupted by engagement of the outer edge of the wedge plate with the bark surface of the tree. Thereupon, the depending bar portion 12*b* is tapped with a hammer on the side thereof opposite from the wedge plate 28 to drive the wedge plate edgewise and radially into the tree to the FIG. 5 position. Also with reference to FIG. 5 the set pin 30 is then driven axially into the butt end of the tree. Thereupon, the screw portion 40 of the screw crank 42 is inserted in the bore 38 in the direction shown in FIG. 3 and then suitably operated to penetrate the tree and cinch the tree firmly up against the bar portion 12*b* at the abutment 44, as shown by the broken line tree position in FIGS. 1 and 2.

The tree is thus firmly locked in place on the holder. Furthermore, the two spaced points of engagement by the wedge plate 28 and the set pin 30 positively anchor the bottom end of the tree and also prevent the tree from twisting or turning axially. The metal used for the tree engaging and holding member 12 is of selected strength such that while capable of firmly holding the tree upright it nevertheless can be bent if forced. Thus, if the tree needs adjustment in its upright position, the operator places a foot on the base 10 and forces the tree to the desired upright position. Bending will mostly occur at the upper portion of member 12. Depending bar portion 12*b* supports the foot plate in suspended relation relative to the floor and the stand is open in the center and can receive a water container C.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A Christmas tree stand comprising a base an upwardly extending post having a lower end secured integrally to said base ring, said post being inclined toward an inner portion of said base ring and terminating in an upper end, a tree holding bar having upper and lower ends, said tree holding bar being vertically and integrally suspended from the upper end of said inclined post, a horizontal foot plate extending integrally from said lower end of said tree holding bar, said foot plate having an upper surface, first and second tree trunk piercing means on said foot plate, said first and second tree trunk piercing means being spaced laterally relative to each other on said foot plate to prevent twisting of a tree supported on the foot plate, said first tree trunk piercing means comprising an integral wedge member extending upwardly from said foot plate adjacent said tree holding bar and arranged to pierce a tree radially adjacent the butt end thereof and said second tree trunk piercing means comprising an axially movable pin having an extended position that pierces the butt end of a tree and a retracted position withdrawn from the tree, and tree steadying means at the upper end of said tree holding bar that engages a tree to hold the tree in upright position.

2. A Christmas tree stand comprising a base ring, an upwardly extending post having a lower end secured integrally to said base ring, said post being inclined toward an inner portion of said base ring and terminating in an upper end, a tree holding bar having upper and lower ends, said tree holding bar being vertically and integrally suspended from the upper end of said inclined post, a horizontal foot plate extending integrally from said lower end of said tree holding bar, said foot plate having an upper surface, first and second tree trunk piercing means on said foot plate, said first and second tree trunk piercing means being spaced laterally relative to each other on said foot plate and arranged to provide a pierced engagement with a tree trunk to prevent twisting of a tree supported on the foot plate, and tree steadying means at the upper end of said tree holding bar that engages the tree to hold the tree in upright position, said tree steadying means including a cross bore in said tree holding bar adjacent the upper end of the tree holding bar, a cinching screw disposed for free rotation in said cross bore, said cinching screw having a piercing point and end threads of a length adjacent said point capable of threaded piercing securement in a tree, and an abutment on said cinching screw engageable with said tree holding bar on the side of the tree holding bar opposite from the side of the tree holding bar which abuts a tree supported on the stand, said abutment upon a tightening threaded engagement of said screw into a tree causing said threads to pull the tree up against the bar for positive securement.

* * * * *

UNITED STATES PATENT AND TRADEMARK OFFICE

CERTIFICATE OF CORRECTION

PATENT NO. : 5,522,177

DATED : 4 June 1996

INVENTOR(S) : John H. Davis

It is certified that error appears in the above-identified patent and that said Letters Patent is hereby corrected as shown below:

Column 1, line 53, "to" should read --top--.

Column 3, line 17, "base" should read --base ring--.

Signed and Sealed this

Thirteenth Day of August, 1996

*Attest:*

Bruce Lehman

BRUCE LEHMAN

*Attesting Officer*

*Commissioner of Patents and Trademarks*